US012338061B2

(12) United States Patent
Friedrich

(10) Patent No.: US 12,338,061 B2
(45) Date of Patent: Jun. 24, 2025

(54) TRANSPORT AND STORAGE CONTAINER FOR LIQUIDS

(71) Applicant: PROTECHNA S.A., Fribourg (CH)

(72) Inventor: Stefan Friedrich, Limburg (DE)

(73) Assignee: PROTECHNA S.A., Fribourg (CH)

( * ) Notice: Subject to any disclaimer, the term of this patent is extended or adjusted under 35 U.S.C. 154(b) by 80 days.

(21) Appl. No.: 18/032,693

(22) PCT Filed: Aug. 12, 2021

(86) PCT No.: PCT/EP2021/072531
§ 371 (c)(1),
(2) Date: Apr. 19, 2023

(87) PCT Pub. No.: WO2022/083915
PCT Pub. Date: Apr. 28, 2022

(65) Prior Publication Data

US 2023/0391544 A1 Dec. 7, 2023

(30) Foreign Application Priority Data

Oct. 21, 2020 (DE) ..... 10 2020 127 721.0

(51) Int. Cl.
*B65D 88/12* (2006.01)
*B65D 90/20* (2006.01)

(52) U.S. Cl.
CPC ..... *B65D 88/128* (2013.01); *B65D 90/20* (2013.01); *B65D 2588/125* (2013.01); *B65D 2590/0066* (2013.01)

(58) Field of Classification Search
CPC .. B65D 90/20; B65D 2588/125; B65D 77/06; B65D 77/061; B65D 77/0466; B65D 77/067; B65D 77/04; B65D 19/10
(Continued)

(56) References Cited

U.S. PATENT DOCUMENTS 5,253,777 A 10/1993 Schutz
5,405,006 A * 4/1995 Burgdorf ..... B65D 77/0466 206/386

(Continued)

FOREIGN PATENT DOCUMENTS

CL 201702001 2/2018
CL 201801676 7/2018

(Continued)

OTHER PUBLICATIONS

Japan Patent Office, Notice of Reasons for Refusal, Application No. 2023-520340, Mar. 28, 2024, 8 pages [English Language Translation Only].

(Continued)

*Primary Examiner* — Robert Poon
(74) *Attorney, Agent, or Firm* — Quarles & Brady LLP

(57) ABSTRACT

A transport and storage container for liquids includes a pallet-type understructure for an inner container made of plastic, the inner container having four side walls, a sealable filling socket formed on an upper bottom and an outlet socket formed on the lower portion of a side wall and having a tapping fitting, the container comprising a cage having horizontal and vertical bars made of metal for receiving the inner container, at least two vertical bars disposed on opposite side walls, being connected at connecting portions by a traverse bar extending over the upper bottom of the inner container which is formed by a hollow profile, the vertical bars having a cross section recess for decreasing a shear force acting on the connecting screw in transition portions formed adjacent to the connecting portions.

4 Claims, 3 Drawing Sheets

(58) Field of Classification Search
USPC ..... 220/562, 495.01, 495.05, 485
See application file for complete search history.

(56) References Cited

U.S. PATENT DOCUMENTS

| | | | | |
|---|---|---|---|---|
| 5,645,185 | A * | 7/1997 | Cassina | B65D 77/0466 220/1.5 |
| 5,678,688 | A | 10/1997 | Udo | |
| 5,971,185 | A * | 10/1999 | Schutz | B65D 77/0466 220/23.9 |
| 6,202,844 | B1 * | 3/2001 | Sedlmayr | B65D 77/0466 206/386 |
| 7,036,662 | B2 | 5/2006 | Schutz | |
| 8,424,702 | B2 * | 4/2013 | Cassina | B65D 77/0466 220/23.91 |
| 10,875,696 | B2 * | 12/2020 | Schütz | B65D 77/0466 |
| 11,034,499 | B2 * | 6/2021 | Maschio | B65D 19/10 |
| 11,220,388 | B2 * | 1/2022 | Klatt | B65D 77/061 |
| 2003/0006235 | A1 | 1/2003 | Przytulla | |
| 2004/0164081 | A1 * | 8/2004 | Schutz | B65D 90/24 220/495.01 |
| 2005/0092639 | A1 | 5/2005 | Schutz | |
| 2011/0073510 | A1 | 3/2011 | Cassina | |
| 2016/0312423 | A1 * | 10/2016 | Kohn | E01H 10/007 |
| 2018/0346220 | A1 | 12/2018 | Weyrauch et al. | |
| 2019/0062024 | A1 | 2/2019 | Maschio | |
| 2020/0165048 | A1 | 5/2020 | Weyrauch | |
| 2021/0221592 | A1 * | 7/2021 | Klatt | B65D 77/0466 |
| 2024/0140675 | A1 * | 5/2024 | Bischoff | B65D 19/10 |

FOREIGN PATENT DOCUMENTS

| | | | |
|---|---|---|---|
| CN | 1923637 | A | 3/2007 |
| DE | 3839647 | A1 | 5/1990 |
| DE | 10 2010 048609 | A1 | 4/2012 |
| DE | 102011087927 | A1 | 6/2013 |
| EP | 1 289 852 | A1 | 3/2003 |
| EP | 3109184 | A1 | 12/2016 |
| JP | 2007055688 | A | 3/2007 |
| JP | 2019510703 | A | 4/2019 |
| RU | 2695837 | C1 | 7/2019 |
| WO | 2012085938 | A1 | 6/2012 |
| WO | 2012085941 | A1 | 6/2012 |

OTHER PUBLICATIONS

National Institute of Industrial Property—INAPI—Chile, Expert Report, Application No. 202301102, Aug. 20, 2024, 11 pages [English Language Translation Only].

PCT International Search Report and Written Opinion, PCT/EP2021/072531, Nov. 11, 2021, 7 pages.

Republic of Colombia, Suerintendency of Industry and Commerce, Office Action and Search Report, Application No. NC2023/0004717, Sep. 10, 2024, 10 pages [English Language Translation Only].

Russia Office Action dated Dec. 14, 2023. (English translation not available).

INPI Argentina—National Institute of Industrial Property, Office Action, Application No. 20210102803, May 3, 2024, 7 pages [English Language Translation Only].

Korean Intellectual Property Office, Office Action, Application No. 10-2023-7012217, Nov. 18, 2024, 6 pages [English Language Translation Only].

* cited by examiner

Fig. 1
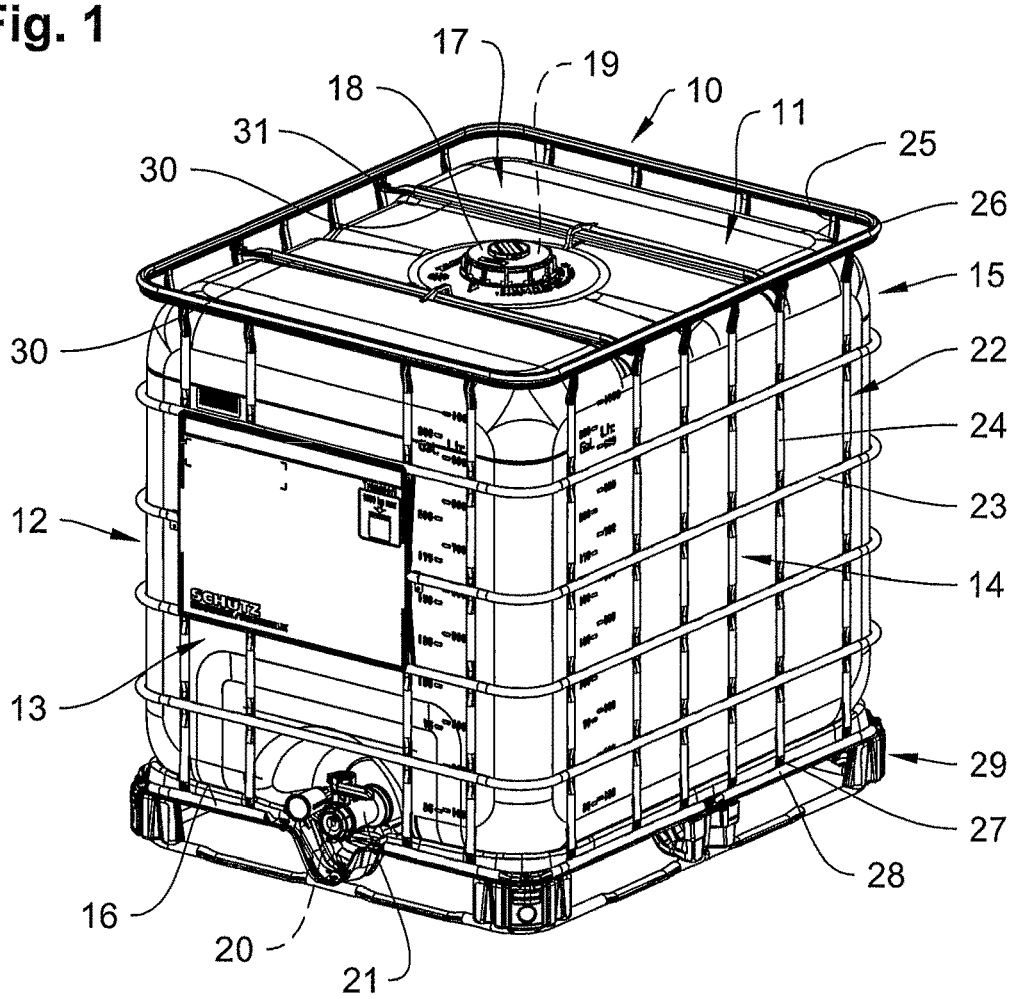
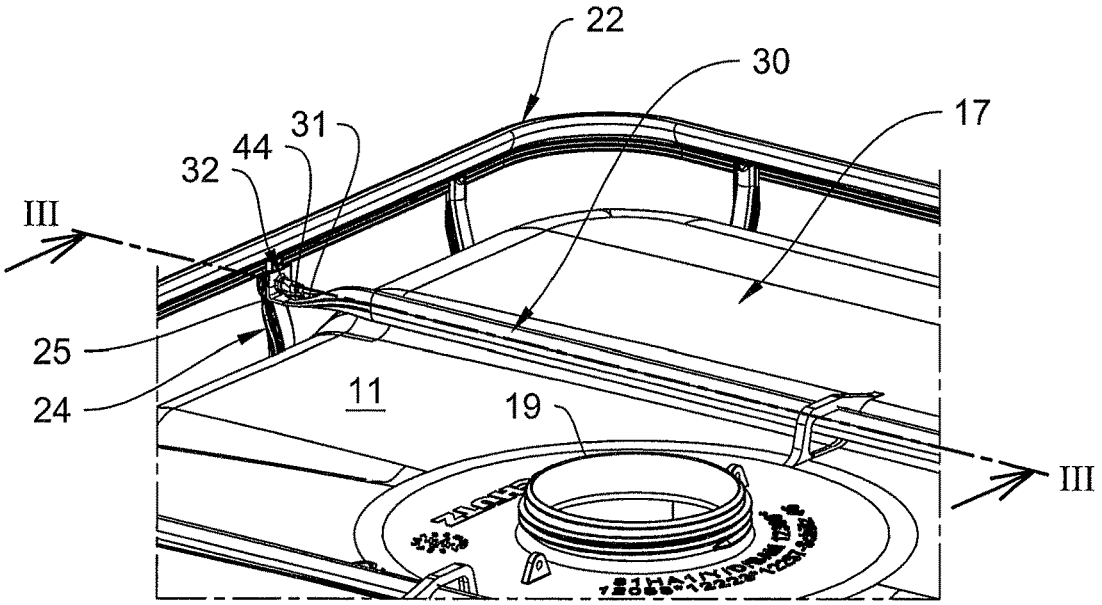
Fig. 2

TRANSPORT AND STORAGE CONTAINER FOR LIQUIDS

This application represents the national stage entry of PCT International Patent Application No. PCT/EP2021/072531 filed on Aug. 12, 2021 and claims priority to German Patent Application No. 10 2020 127 721.0 filed on Oct. 21, 2020. The contents of each of these applications are hereby incorporated by reference as if set forth in their entirety herein.

The present disclosure relates to a transport and storage container for liquids comprising a pallet-type understructure for an inner container made of plastic, the inner container having four side walls, a lower and an upper bottom, a sealable filling socket which is formed on the upper bottom and an outlet socket which is formed on the lower portion of a side wall, said outlet socket having a tapping fitting, the transport and storage container comprising a cage having horizontal and vertical bars made of metal for receiving the inner container, ends of the vertical bars, which are formed by a hollow profile, being welded to a lower and an upper circumferential edge profile of the cage, the upper ends of the vertical bars having a connecting portion in order to be connected to the upper edge profile, said connecting portion having a flat section which is formed from the hollow profile by deforming, at least two vertical bars, which are disposed on opposite side walls, being connected at the connecting portions by means of a traverse bar which extends over the upper bot-tom of the inner container and which is formed by a hollow profile, a connecting portion of a vertical bar being connected to a connecting portion formed on the ends of the traverse bar by deforming the hollow profile to a flat section via a screwed joint in each case, the connecting portions of the traverse bar being bent open with respect to a longitudinal portion, which extends over the upper bottom of the inner container, and extending towards the connecting portions of the vertical bars, and the connecting portions of the traverse bar having a fastening opening with a wall for forming a threaded engagement with a connecting screw, which is guided through a passage opening of the connecting portion of the vertical bar.

Transport and storage containers of the make mentioned above are subject to a compliance inspection depending on their type to ensure that defined safety standards are adhered to when using the transport and storage containers, which are also referred to as IBCs. In the course of such compliance inspections, in particular the compressive strength of the transport and storage containers is inspected by applying increased hydraulic internal pressure to the inner container with the result that corresponding deformation forces which act on the inner container must be absorbed by the cage which receives the inner container. The screwed joints which are formed between the connecting portions of the vertical bars and the connecting portions of the traverse bar are subjected to excessive stress since shear forces act on the screwed joints in the area of the connecting portions, which can cause a widening of the threaded hole formed in the connecting portions of the traverse bar, with the result that the threaded engagement between the connecting screws and the connecting portions of the traverse bar is disengaged, resulting in a corresponding component failure.

The object of the present disclosure is to propose a transport and storage container which is characterized by an improved safety against failure regarding the screwed joint formed between the traverse bars and the cage.

This object is attained by the transport and storage container according to the disclosure having the features of claim 1.

According to the disclosure, the vertical bars which are connected to each other via the traverse bar or the traverse bar have/has a cross section recess for decreasing a shear force acting on the connecting screw in transition portions, which are formed adjacent to the connecting portions in the transition area towards the hollow profile.

Tests have shown that the shear forces relevant for the component safety of the screwed joint are essentially caused by the fact that a deforming of the traverse bar occurs when the inner container expands because of increased hydraulic internal pressure, said deforming occurring in such a manner that the transition portion which is adjacent to the connecting portion of the traverse bar comes into contact with the screw end protruding from the fastening opening of the connecting portion of the traverse bar, such that deformation forces act on the connecting screw as shear forces via the transition portion and, as a result of the widening of the wall of the fastening opening, the threaded engagement between the connecting screw and the connecting portions of the traverse bar is disengaged.

By means of the cross section recess according to the disclosure, which can be formed in the transition portions of the vertical bars or in the transition portions of the traverse bar or both in the transition portions of the vertical bars and in the transition portions of the traverse bar, the forming of a physical contact between the transition portions of the traverse bar and the connecting screw can be prevented, such that corresponding harmful shear forces on the connecting screw can be avoided.

According to a preferred embodiment of the disclosure, the cross section recess in the transition portions of the traverse bar is formed opposite a screw end protruding from the fastening opening and serves to receive the screw end when the transition portion approaches the screw end. Such an embodiment of the cross section recess enables the deformation path of the traverse bar to increase as a result of an expansion of the inner container without the traverse bar and the screw end being able to come into contact. Thus, a physical contact between the traverse bar and the screw end is avoided or the possible deformation path of the traverse bar is increased before a physical contact is formed.

The cross section recess in the transition portions of the traverse bar can be formed as a depression or a recess which is formed between longitudinal edges of the traverse bar. A depression is particularly advantageous, such that in contrast to a recess or a hollow extending over the total width of the transition piece, an increased bending stiffness of the traverse bar is maintained in the area of the transition portions.

According to another preferred embodiment of the disclosure, the cross section recess in the transition portions of the vertical bars forms a predetermined bending point which allows a pivoting of the connecting portions away from the inner container around the predetermined bending point and outwards around an axis which is parallel to the upper edge profile when a shear force acts on the connecting portions via the traverse bar. In such an embodiment, a physical contact between the traverse bar and the screw end, which would be harmful to the strength of the screwed joint, is prevented from forming or is delayed because the decreased bending stiffness of the transition portion of the vertical bars causes the connecting portions of the vertical bars to perform an outward pivoting motion around the predetermined bending point in the same direction as the deformation of the traverse bar.

It has proven to be particularly advantageous if the predetermined bending point is formed as a groove which his disposed on an outer surface of the vertical bars in the transition portion and which extends parallel to the upper edge profile, such that a reduced bending stiffness desired in the area of the predetermined bending point is achieved.

Hereinafter, preferred embodiments of the disclosure will be described in more detail with reference to the drawings.

FIG. 1 shows a perspective view of a transport and storage container comprising a cage which is provided with traverse bars on its upper edge profile;

FIG. 2 shows an enlarged view of a traverse bar connecting area which is formed on the cage;

Figure 3:
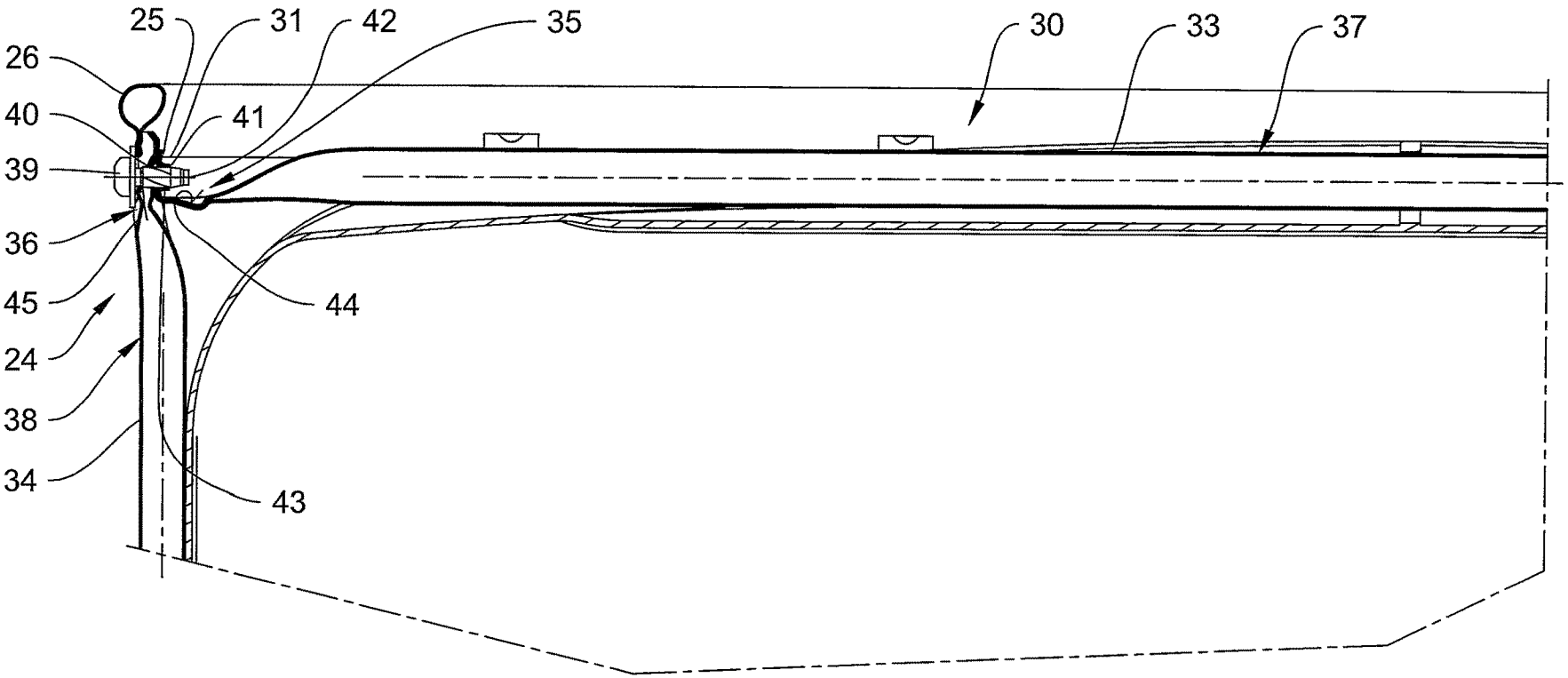
FIG. 3 shows a sectional view of the traverse bar connecting area shown in FIG. 2 according to cutting line in FIG. 2.

FIG. 1 shows a transport and storage container 10 for liquids which can be used as a disposable container and as a reusable container and which comprises an inner container 11 made of plastic, inner container 11 having four side walls 12, 13, 14 and 15 and a lower and an upper bottom 16, 17, a filling socket 19 which is formed on upper bottom 17 and which is sealable with a lid 18, and an outlet socket 20 which is formed on the lower portion of front side wall 13, said outlet socket 20 having a tapping fitting 21, transport and storage container 10 further comprising an outer cage 22 formed by intersecting horizontal and vertical bars 23, 24 made of metal for receiving inner container 11. Vertical bars 24 are welded to an upper edge profile 26 via an upper connecting portion 25 and to a lower edge profile 28 of cage 22 via a lower connecting portion 27. Furthermore, cage 22 is connected to a pallet-type understructure 29 via its lower edge profile 28.

As FIG. 1 shows, cage 22 is provided with two traverse bars 30 which extend over upper bottom 17 of inner container 11 and which extend parallel to each other in the case at hand and which are connected to upper connecting portion 25 of a vertical bar 24 in a force-fitting manner via a screwed joint 32 at connecting portions 31 formed on each of their longitudinal ends, as is illustrated in FIG. 2. As FIG. 3 shows, both connecting portion 31 of traverse bar 30 and connecting portion 25 of vertical bar 24 are each formed by a flat section of traverse bar 30 and of vertical bar 24, which are formed by hollow profiles 33 and 34, respectively, and are separated from longitudinal portions 37 and 38, which are formed by hollow profiles 33 and 34, by means of transition portions 35 and 36, respectively.

As in particular FIG. 3 shows, connecting portion 31 of traverse bar 30 is bent open with respect to longitudinal portion 37 of traverse bar 30 in such a manner that connecting portion 31 of traverse bar 30 and connecting portion 25 of vertical bar 24 extend in essentially parallel planes, connecting portions 31, 25 being connected to each other in a force-fitting manner by means of a connecting screw 39 which extends through a passage opening 40 formed in connecting portion 25 of vertical bar 24 and through a fastening opening 41 formed in connecting portion 31 of traverse bar 30.

To form the force fit, connecting screw 39 is screwed into fastening opening 41, which is formed as a threaded hole, with a screw end 42, which penetrates fastening opening 41, in such a manner that a threaded engagement is produced between a wall 43 of fastening opening 41 and screw end 42.

In particular FIGS. 2 and 3 show that, in the present embodiment of the transport and storage container, both transition portion 35, which is formed between connecting portion 31 and longitudinal portion 37 of traverse bar 30, and transition portion 36, which is formed between connecting portion 25 and longitudinal portion 38 of vertical bar 24, have a cross section recess which is formed as a depression 44 or a groove 45, depression 44 being formed opposite screw end 42 which protrudes from fastening opening 41, and groove 45 being formed in an outer surface 46 of bar 24 which faces away from inner container 11 and extending parallel to upper edge profile 26.

Figure 4:
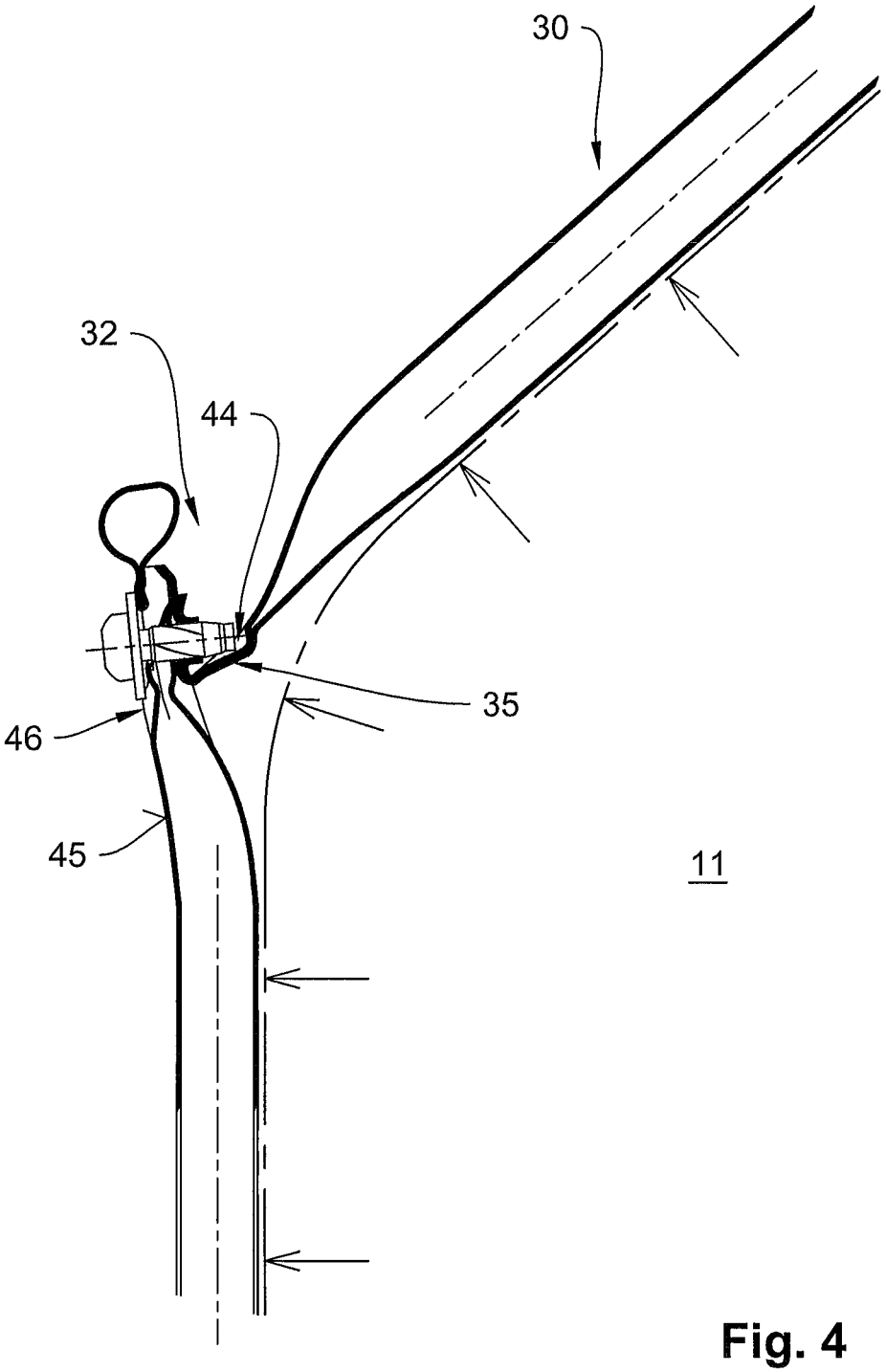
FIG. 4 shows an enlarged view of the traverse bar connecting area illustrated in FIG. 3 in a case where an inner container of the transport and storage container illustrated in FIG. 1 is subjected to increased internal pressure.

To explain the advantageous effect of depression 44 and groove 46 in a case where an inner container 11 is subject to increased hydraulic internal pressure, FIG. 4 schematically illustrates the deformation state in the area of screwed joint 32. As a comparison between the undeformed state of screwed joint 32 (illustrated in FIG. 3) and the deformation state (illustrated in FIG. 4) shows, forming depression 44 in transition portion 35 of traverse bar 30 allows transition portion 35 to approach screw end 42 in the event of a deformation, without forming a physical contact between screw end 42 and transition portion 35. Depression 44 forms a free space in transition portion 35 into which screw end 42 can plunge when transition portion 35 approaches screw end 42.

Furthermore, a comparison between the illustrations in FIGS. 3 and 4 shows that groove 45 which is formed on outer surface 46 of vertical bar 24 in transition portion 36 forms a predetermined bending point, which allows a pivoting of connecting portions 31, 25 around the predetermined bending point and outwards around an axis which is parallel to upper edge profile 26 when a shear force acts on connecting portions 25, 31 via traverse bar 30 as a result of the expansion of inner container 11, such that, in addition to the aforementioned possibility of plunging into depression 44, screw end 42 of connecting screw 39 can also avoid the approaching of transition portion 35 of traverse bar 30 because of this pivoting motion.

As can be derived from the above, both the forming of depression 44 in transition portion 35 of traverse bar 30 and the forming of groove 45 in transition portion 36 of vertical bar 24 allow avoiding a physical contact between transition portion 35 of traverse bar 30 and screw end 42, the simultaneous forming of depression 44 and groove 46 in the illustrated embodiment allowing a particularly advantageous overlapping of the effects.

The invention claimed is:

1. A transport and storage container for liquids comprising:

a pallet understructure;

a cage coupled to the pallet understructure, the cage comprising horizontal and vertical bars made of metal, the vertical bars having upper and lower ends formed by a hollow profile and welded to a lower and an upper circumferential edge profile of the cage, the upper ends of the vertical bars having a connecting portion to be connected to the upper edge profile, said connecting portion being formed by deforming the hollow profile to a flat section, the connecting portions having a passage opening; and a traverse bar formed by a hollow profile and having connecting portions formed on ends of the traverse bar by deforming the hollow profile of the traverse bar to a flat section, the connecting portions of the traverse bar having a fastening opening with a wall for forming a threaded engagement with a connecting screw, the traverse bar further comprising transition portions formed adjacent to the connecting portions and having a cross section recess; and an inner container made of plastic received in the cage; the inner container having four side walls, a lower and an upper bottom, a sealable filling socket which is formed on the upper bottom and an outlet socket which is formed on a lower portion of a side wall, said outlet socket having a tapping fitting, wherein the connecting portions of at least two vertical bars, which are disposed on opposite side walls, are connected at the connecting portions by the traverse bar which extends over the upper bottom of the inner container, such that the connecting portions of the vertical bars are connected to the connecting portions of the traverse bar, the connecting portions of the traverse bar are bent upward with respect to a longitudinal portion of the traverse bar, the longitudinal portion extends over the upper bottom of the inner container, and the connection portions of the traverse bar extend in parallel to the connecting portions of the vertical bars, wherein the connecting portions of the vertical bars and the connecting portions of the traverse bar are connected via a screwed joint in each case, such that the connecting screw is guided through the passage opening of the connecting portions of the vertical bars and engaged with the fastening opening of the connection portions of the traverse bar, wherein the cross section recess of the transition portion of the traverse bar is formed opposite a screw end of the connecting screw protruding from the fastening opening.

2. The container according to claim 1, wherein the cross section recess is formed as a depression or a recess which is formed between longitudinal edges of the traverse bar in the transition portion of the traverse bar.

3. The container according to claim 1, wherein the vertical bars have cross section recesses in the transition portion, each of the cross section recesses in the transition portions of the vertical bars forming a predetermined bending point which allows a pivoting of the connecting portions away from the inner container around the predetermined bending point and outwards around an axis which is parallel to the upper edge profile when a shear force acts on the connecting portions via the traverse bar.

4. The container according to claim 3, wherein the predetermined bending point is formed as a groove which is disposed on an outer surface of the vertical bars in the transition portion and which extends parallel to the upper edge profile.

* * * * *